US010438759B2

(12) United States Patent
Tamura et al.

(10) Patent No.: US 10,438,759 B2
(45) Date of Patent: Oct. 8, 2019

(54) KEY SWITCH DEVICE

(71) Applicant: Lenovo (Singapore) Pte. Ltd., Singpaore (SG)

(72) Inventors: Fumio Tamura, Tokyo (JP); Kenshin Yonemochi, Kanagawa-ken (JP)

(73) Assignee: Lenovo (Singapore) Pte. Ltd., Singapore (SG)

( * ) Notice: Subject to any disclaimer, the term of this patent is extended or adjusted under 35 U.S.C. 154(b) by 230 days.

(21) Appl. No.: 13/711,165

(22) Filed: Dec. 11, 2012

(65) Prior Publication Data

US 2013/0146434 A1 Jun. 13, 2013

(30) Foreign Application Priority Data

Dec. 12, 2011 (JP) ..... 2011-271566

(51) Int. Cl.
*H01H 13/14* (2006.01)
*H01H 13/705* (2006.01)
*H01H 3/12* (2006.01)

(52) U.S. Cl.
CPC ..... *H01H 13/14* (2013.01); *H01H 3/125* (2013.01); *H01H 13/705* (2013.01); *H01H 2227/004* (2013.01); *H01H 2227/006* (2013.01); *H01H 2227/008* (2013.01); *Y10T 29/49826* (2015.01)

(58) Field of Classification Search
CPC .... H01H 3/125; H01H 13/7065; H01H 13/14; H01H 13/705; H01H 2227/008; H01H 2227/006; H01H 2227/004; H01H 13/70
USPC ..... 200/344, 345, 5 A
See application file for complete search history.

(56) References Cited

U.S. PATENT DOCUMENTS

| | | | | |
|---|---|---|---|---|
| 5,268,545 | A * | 12/1993 | Bruner | 200/345 |
| 5,947,616 | A * | 9/1999 | Liang | 400/491.2 |
| 6,150,624 | A * | 11/2000 | Yao | 200/344 |
| 6,152,627 | A | 11/2000 | Watanabe et al. | |
| 8,080,755 | B2 * | 12/2011 | Cheng | 200/344 |
| 8,101,879 | B2 * | 1/2012 | Nishino | 200/344 |
| 8,404,984 | B2 * | 3/2013 | Liu | 200/5 A |
| 2012/0048702 | A1 * | 3/2012 | Liu | H01H 3/125 200/5 A |

FOREIGN PATENT DOCUMENTS

| | | | |
|---|---|---|---|
| CN | 1728311 | A | 2/2006 |
| CN | 2826655 | Y | 10/2006 |
| JP | 2000-173389 | A1 | 6/2000 |
| JP | 2001184979 | A1 | 6/2001 |
| JP | 2003-151394 | A1 | 5/2003 |
| JP | 2006-040699 | A1 | 2/2006 |
| TW | 426187 | U | 3/2001 |

* cited by examiner

*Primary Examiner* — Edwin A. Leon
*Assistant Examiner* — Lheiren Mae A Caroc
(74) *Attorney, Agent, or Firm* — Ference & Associates LLC

(57) ABSTRACT

One aspect provides a key switch device including: a base plate; a sheet laminated on the base plate; a key top disposed above the sheet; and an elastic dome that is disposed between the sheet and the key top and is configured to press the sheet in response to the key top being pressed down. Other aspects are described and claimed.

14 Claims, 10 Drawing Sheets

KEY SWITCH DEVICE

CLAIM FOR PRIORITY

This application claims priority to Japanese Patent Application Serial No. 2011-271566, filed Dec. 12, 2011, the contents of which are incorporated by reference in their entirety.

FIELD

The subject matter described herein relates to a key switch device that is used in a keyboard of an electronic apparatus such as a personal computer.

BACKGROUND

A key switch device includes a base plate, a sheet laminated on the base plate, a key top disposed above the sheet, a rubber dome that is disposed between the sheet and the key top and presses the sheet in a case where the key top is pressed down, and a guide mechanism that is foldably mounted between the base plate and the key top and supports the key top so as to be movable up and down.

Incidentally, if a small keystroke of the key switch device described above is made, even when the center of the key top is pressed down, the lower end face of the key top or a portion of the guide mechanism approaches to the extent that it comes into contact with the sheet laminated on the base plate. Therefore, when a portion distant from the center of the key top is pressed down, the lower end face of the key top or a portion of the guide mechanism impacts against the sheet laminated on the base plate. Since impact when the lower end face of the key top or a portion of the guide mechanism impacts against the sheet laminated on the base plate is equal to impact when the lower end face of the key top or a portion of the guide mechanism impacts against the base plate and is turned into a bottom-out feeling, thereby being transmitted to the finger that operates the key top, so is undesirable.

In order to suppress such a bottom-out feeling when operating a key, providing a gap between an upper sheet and a lower sheet which constitute the sheet, at the portion corresponding to the lower end face of the key top of the sheet, has been proposed (Japanese Patent Application Laid-Open No. 2001-184979).

BRIEF SUMMARY

In summary, one aspect provides a key switch device comprising: a base plate; a sheet laminated on the base plate; a key top disposed above the sheet; and an elastic dome that is disposed between the sheet and the key top and is configured to press the sheet in response to the key top being pressed down.

Another aspect provides an apparatus, comprising: a housing having a keyboard disposed therein; said keyboard comprising a plurality of key switch devices; at least one of the plurality of key switch devices comprising: a base plate; a sheet laminated on the base plate; a key top disposed above the sheet; and an elastic dome that is disposed between the sheet and the key top and is configured to press the sheet in response to the key top being pressed down.

A further aspect provides a method, comprising: laminating a sheet on a base plate; disposing a key top above the sheet; and disposing an elastic dome between the sheet and the key top, the elastic dome being configured to press the sheet in response to the key top being pressed down.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
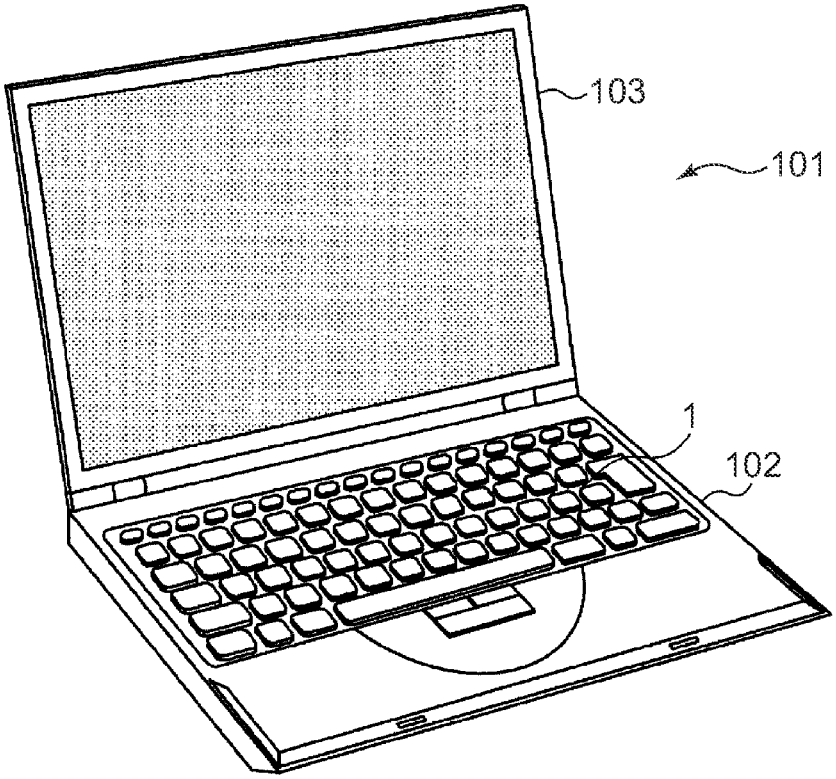
FIG. 1 is a perspective view illustrating a personal laptop computer provided with a keyboard in which a key switch device that is an embodiment of the invention is disposed in a large number.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

As proposed in Japanese Patent Application Laid-Open No. 2001-184979, even if a gap is provided between the upper sheet and the lower sheet which constitute the sheet, at the portion corresponding to a lower end edge of the key top of the sheet, since the gap is small, an effect is not achieved.

Accordingly, an embodiment has been made in view of the above and provides a key switch device in which even if a small keystroke is made, a bottom-out feeling when operating a key is able to be suppressed. In order to solve the above-described problem, according to an embodiment, there is provided a key switch device including: a base plate; a sheet laminated on the base plate; a key top disposed above the sheet; a rubber dome that is disposed between the sheet and the key top and presses the sheet in a case where the key top is pressed down; and a guide mechanism that is foldably mounted between the base plate and the key top and supports the key top so as to be movable up and down, wherein projections are provided on the surface facing the sheet of the key top or the surface facing the sheet of the guide mechanism, which approaches the sheet in a case where the key top is pressed down, and also receiving portions which receive the projections are provided in areas facing the projections in the base plate in a case where the key top is pressed down.

Further, in an embodiment, the sheet may be a switch sheet in which a switch that is pressed by the rubber dome, thereby closing contacts. Further, in an embodiment, the sheet may be a dome sheet to which the rubber dome is fixed. In an embodiment the receiving portions may pass through the base plate.

In a key switch device according to an embodiment, since the projections are provided on the surface facing the sheet of the key top or the surface facing the sheet of the guide mechanism, which approaches the sheet in a case where the key top is pressed down, and also the receiving portions which receive the projections are provided in areas facing the projections in the base plate in a case where the key top is pressed down, even in a case where a portion distant from the center of the key top is pressed down, the projections do not bounce off the base plate under the sheet and the sheet buffers impact when the projections impact against the sheet. In this way, even if a small keystroke is made, a bottom-out feeling when operating a key is able to be suppressed.

Hereinafter, example embodiments of a key switch device will be described in detail on the basis of the drawings. These are non-limiting examples.

FIG. 1 is a perspective view illustrating a personal laptop computer provided with a keyboard to which a key switch device is applied. As illustrated in FIG. 1, a personal laptop computer 101 includes a main body 102 and a lid body 103 supported so as to be capable of being opened and closed with respect to the main body. In the main body 102, in addition to a keyboard in which a key switch device 1 that is disposed in a large number, a power supply, a system board, a memory, a hard disk drive, an optical drive, a battery pack, etc. are mounted, and in the lid body 103, an LCD unit, etc. are mounted.

Figure 2:
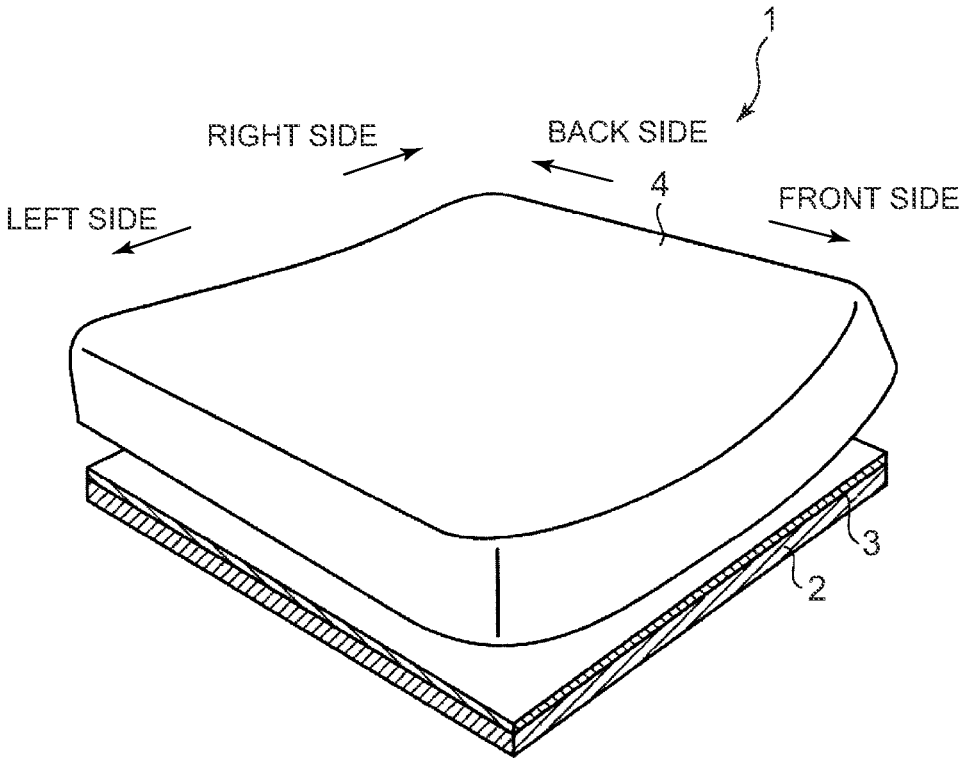
FIG. 2 is a perspective view of a key switch device that is Embodiment 1 of the invention, as viewed from the upper left side.
Figure 3:
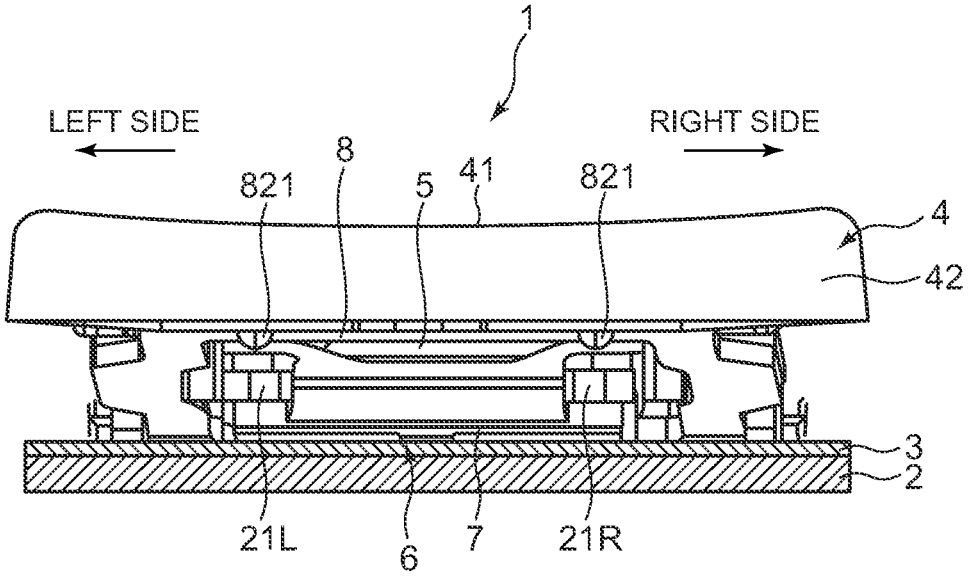
FIG. 3 is a front view of the key switch device illustrated in FIG. 2.
Figure 4:
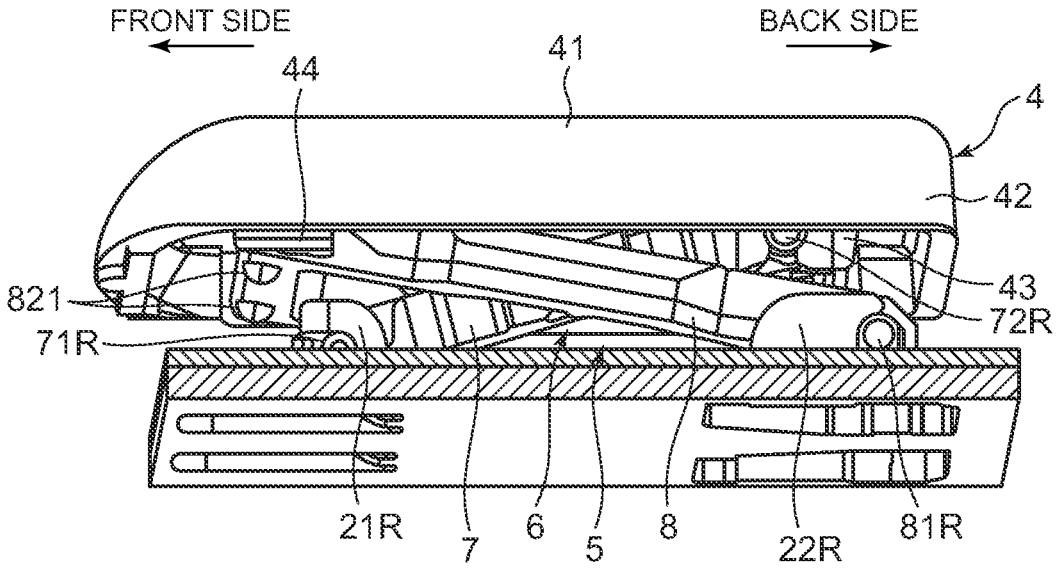
FIG. 4 is a perspective view of the key switch device illustrated in FIG. 2, as viewed from the lower right side.
Figure 5:
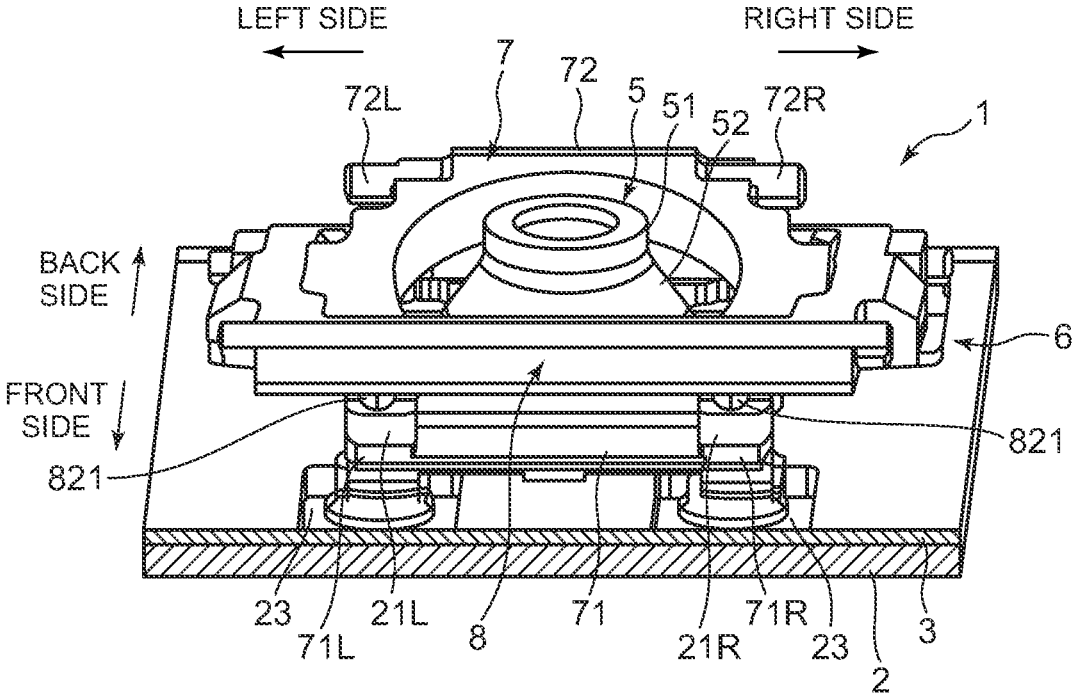
FIG. 5 is a perspective view of the key switch device illustrated in FIG. 2, as viewed from the upper front side, and is a diagram in which a key top is omitted.
Figure 6:
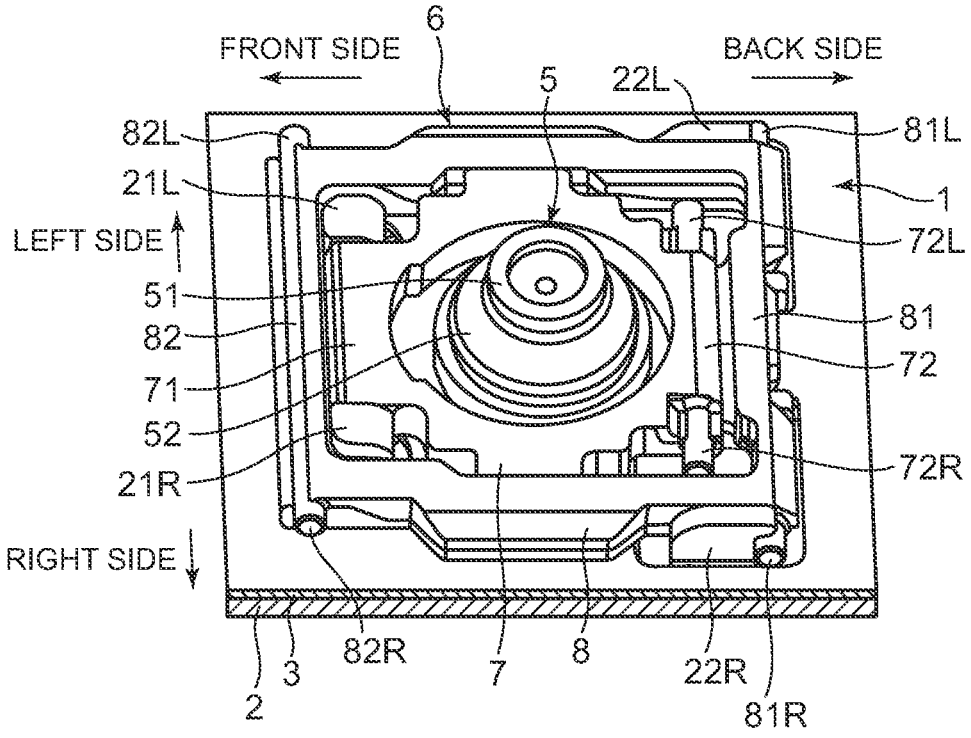
FIG. 6 is a perspective view of the key switch device illustrated in FIG. 2, as viewed from the upper right side, and is a diagram illustrating a state where the key top is removed.
Figure 7:
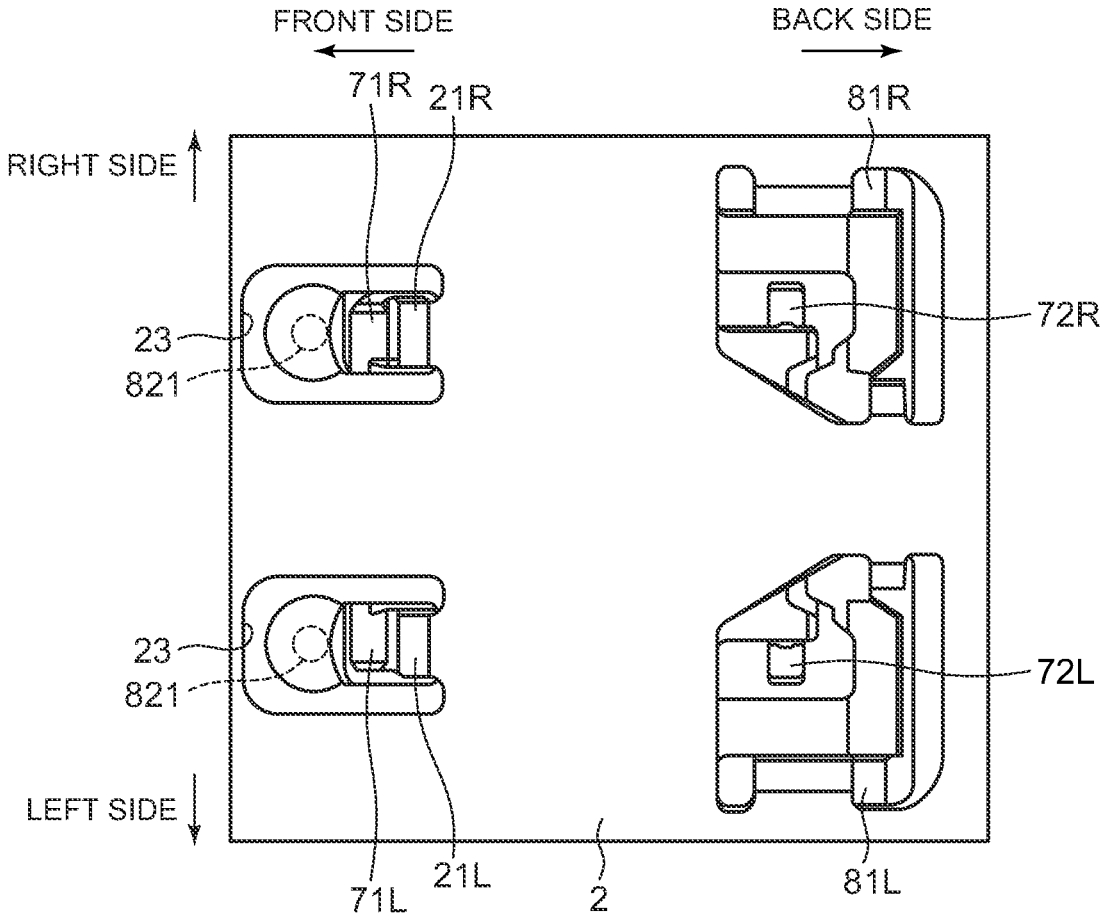
FIG. 7 is a bottom view of the key switch device illustrated in FIG. 2.

FIG. 2 is a perspective view of a key switch device according to an embodiment, as viewed from the upper left side. FIG. 3 is a front view of the key switch device illustrated in FIG. 2, and FIG. 4 is a perspective view of the key switch device illustrated in FIG. 2, as viewed from the lower right side. Further, FIG. 5 is a perspective view of the key switch device illustrated in FIG. 2, as viewed from the upper front side, and is a diagram illustrating a state where a key top is omitted, and FIG. 6 is a perspective view of the key switch device illustrated in FIG. 2, as viewed from the upper right side, and is a diagram illustrating a state where the key top is removed. Further, FIG. 7 is a bottom view of the key switch device illustrated in FIG. 2.

As illustrated in FIG. 2, the key switch device 1 according to an embodiment includes a base plate 2, a membrane sheet 3, a key top 4, a rubber dome 5 (refer to FIG. 5), and a guide mechanism 6 (refer to FIG. 5).

The base plate 2 becomes a substrate of the key switch device 1, and all the key switch devices 1 which are disposed at a single keyboard share a single base plate 2. The base plate 2 is formed by performing cut and raise shaping or punching shaping on a plate-like body made of metal and locking pieces 21L, 21R, 22L, and 22R for mounting the guide mechanism 6 described above are formed on the upper surface of the base plate 2 by the cut and raise shaping or the punching shaping.

In the base plate 2 of the key switch device 1 that is this embodiment, the locking pieces 21L, 21R, 22L, and 22R for mounting the guide mechanism 6 are formed on the upper surface of the base plate 2 by performing the cut and raise shaping or the punching shaping on an aluminum plate having a thickness of 0.6 mm.

The membrane sheet 3 is a switch sheet having a three-layer structure, in which contacts are closed in a case of being pressed, and is laminated on the base plate 2 described above. The membrane sheet 3 includes a lower sheet with a fixed contact formed on the upper surface thereof, an upper sheet with a movable contact facing the fixed contact formed on the lower surface thereof, and a spacer sheet which is provided between the lower sheet and the upper sheet and separates the fixed contact and the movable contact in a normal state. In the membrane sheet 3, in a case where a position where the fixed contact and the movable contact overlap is pressed, the fixed contact and the movable contact come close contact with each other, whereby the contacts are closed.

The membrane sheet 3 of the key switch device 1 that is this embodiment includes the lower sheet having a thickness of 0.075 mm (75 micrometer), the spacer sheet having a thickness of 0.050 mm (50 micrometer), and the upper sheet having a thickness of 0.075 mm (75 micrometer), and has a thickness of a total of 0.25 mm due to an adhesive bonding the lower sheet to the spacer sheet and an adhesive bonding the spacer sheet to the upper sheet.

As illustrated in FIGS. 2 and 3, the key top 4 is an operation member for inputting a signal and is disposed above the membrane sheet 3. The key top 4 is formed in a rectangular parallelepiped shape having a rectangle in a plan view and has an upper surface 41 which becomes an operation surface and side surfaces 42 extending downward from the upper surface 41. The middle of the upper surface 41 is formed as a recessed curved surface so as to make the finger reliably operate a key (the key top 4). As illustrated in FIG. 4, the lower surface of the key top 4 is opened, and the inside of the lower surface of the key top 4 becomes a space for disposing the rubber dome 5 or the guide mechanism 6. Further, shaft hole portions 43 and 44 which support the guide mechanism 6 are formed on the bottom of the inside of the lower surface of the key top 4. In addition, a shaft hole and a groove which is connected to the shaft hole are formed in each of the shaft hole portions.

In addition, the key top 4 of the key switch device 1 is formed in a rectangular parallelepiped shape having a rectangle in a plan view. However, the key top 4 may also be formed in a truncated pyramid shape (a truncated quadrangular pyramid shape) in which the side surfaces 42 extending downward from the upper surface 41 extend to spread toward the bottom.

As illustrated in FIGS. 5 and 6, the rubber dome 5 is for pressing the membrane sheet 3 in a case where the key top 4 is pressed down, and is disposed between the membrane sheet 3 and the key top 4. The rubber dome 5 is formed of an elastic material having flexibility like silicon rubber or the like. The rubber dome 5 has a top portion 51 which comes into contact with the key top 4 and a base portion 52 which comes into contact with the membrane sheet 3. The top portion 51 is formed in a bottomed cylindrical shape, and the base portion 52 is formed so as to be widened in the shape of an umbrella toward the lower side from a lower end of the top portion 51. A lower end of the base portion 52 is formed in the shape of a flange and bonded to the membrane sheet 3. Further, the rubber dome 5 has a pressing portion 53 (refer to FIG. 9) which presses the membrane sheet 3, in the inside of the base portion 52. The pressing portion 53 is formed in a conical shape which is gradually tapered toward the lower side from the bottom of the top portion 51.

Then, in a case where an operating force is applied to the key top 4, so that the key top 4 is pressed down, the operating force is transmitted to the top portion 51 of the rubber dome 5, so that the base portion 52 is elastically deformed and also the pressing portion 53 presses the membrane sheet 3. In this way, the membrane sheet 3 closes the contacts. On the other hand, if the operating force is eliminated from the key top 4, an elastic restoring force acts on the rubber dome 5, so that the base portion 52 returns to the original form and the pressing portion 53 also returns to the original position. In this way, the key top 4 returns to the original position and also the membrane sheet 3 opens the contacts.

The guide mechanism 6 is for supporting the key top 4 so as to be movable up and down and is foldably mounted between the base plate 2 and the key top 4, as illustrated in FIG. 3. As illustrated in FIGS. 4 to 6, the guide mechanism 6 includes an inner frame 7 and an outer frame 8 paired with the inner frame 7.

The inner frame 7 is a frame body into which the rubber dome 5 is inserted, and has an outer shape formed in a rectangular shape in a plan view and an inner shape formed in a circular shape in a plan view. Shafts 71L and 71R which extend laterally are respectively formed on the left side and right side of a front side end portion 71 of the inner frame 7, and shafts 72L and 72R which extend laterally are respectively formed on the left side and right side of a back side end portion 72 of the inner frame 7. The shafts 71L and 71R formed on the left side and right side of the front side end portion 71 of the inner frame 7 are movably and rotatably locked to the locking pieces 21L and 21R formed on the upper surface of the base plate 2, and the shafts 72L and 72R formed on the left side and right side of the back side end portion 72 of the inner frame 7 are rotatably supported in the shaft holes of the shaft hole portions 43 provided at the key top 4.

The outer frame 8 is a frame body in which the inner frame 7 is fitted, and each of an outer shape and an inner shape thereof is formed in a rectangular shape in a plan view. Shafts 81L and 81R which extend laterally are respectively formed on the left side and right side of a back side end portion 81 of the outer frame 8, and shafts 82L and 82R which extend laterally are respectively formed on the left side and right side of a front side end portion 82 of the outer frame 8. The shafts 81L and 81R formed on the left side and right side of the back side end portion 81 of the outer frame 8 are movably and rotatably locked to the locking pieces 22L and 22R formed on the upper surface of the base plate 2, and the shafts 82L and 82R formed on the left side and right side of the front side end portion 82 of the outer frame 8 are rotatably supported in the shaft holes of the shaft hole portions 44 provided on the bottom surface of the key top 4.

In this way, the inner frame 7 and the outer frame 8 are mounted in a diagonally crossing manner and support the key top 4 so as to be movable up and down.

Incidentally, in the key switch device 1 of an embodiment, projections 821 are provided on the surface facing the membrane sheet 3 of the guide mechanism 6 which approaches the membrane sheet 3 in a case where the key top 4 is pressed down, and also receiving portions 23 are provided in areas facing the projections 821 in the base plate 2 in a case where the key top 4 is pressed down (refer to FIG. 7).

As illustrated in FIGS. 4 and 5, the projections 821 are provided so as to impact against the membrane sheet 3 in a case where a portion distant from the center of the key top 4 is pressed down, and in this way, in a case where the portion distant from the center of the key top 4 is pressed down, other portions of the guide mechanism 6 or the lower end face of the key top 4 does not impact against the membrane sheet 3.

In the key switch device 1, two projections 821 are provided on the lower surface of the front side end portion 82 of the outer frame 8 constituting the guide mechanism 6, so as to divide the front side end portion 82 into three portions. Each of the two projections 821 is formed in a semi-spherical shape, and thus, even if the projections 821 impact against the membrane sheet 3, the projections 821 do not damage the membrane sheet 3.

The receiving portions 23 are provided so as to make the lower sides of areas against which the projections 821 impact, of the membrane sheet 3, into cavities, and in this way, even if the projections 821 impact against the membrane sheet 3, the projections 821 do not bounce off the base plate 2 under the membrane sheet 3, so that the receiving portions 23 function as cushions to mitigate impact.

In the key switch device 1 areas where the locking pieces 21L and 21R supporting the inner frame 7 are cut and raised are set to be the receiving portions 23. In the key switch device 1, in a case where an operating force is applied to a portion that becomes the center of the key top 4, so that the key top 4 is pressed down, the operating force is transmitted to the top portion 51 of the rubber dome 5, so that the base portion 52 of the rubber dome 5 is elastically deformed and also the pressing portion 53 of the rubber dome 5 presses the membrane sheet 3. In this way, the membrane sheet 3 closes the contacts. At this time, the guide mechanism 6 guides the downward movement of the key top 4. However, the inner frame 7 or the outer frame 8 constituting the guide mechanism 6 does not impact against the membrane sheet 3 laminated on the base plate 2.

Then, if the operating force is eliminated from the key top 4, an elastic restoring force acts on the rubber dome 5, so that the base portion 52 of the rubber dome 5 returns to the original form and the pressing portion 53 of the rubber dome 5 also returns to the original position. In this way, the key top 4 returns to the original position and also the membrane sheet 3 opens the contacts. At this time, the guide mechanism 6 guides the upward movement of the key top 4.

On the other hand, even in a case where an operating force is applied to a portion distant from the center of the key top 4, the guide mechanism 6 guides the downward movement of the key top 4. However, since the operating force is applied to the portion distant from the center of the key top 4, the projections 821 provided at the outer frame 8 of the guide mechanism 6 impact against the membrane sheet 3 and other portions of the inner frame 7 or the outer frame 8 of the guide mechanism 6 do not impact against the membrane sheet 3. Then, even if the projections 821 impact against the membrane sheet 3, since the receiving portions 23 are provided in areas facing the projections 821 in the base plate 2, the projections 821 do not bounce off the base plate 2 under the membrane sheet 3, so that impact is mitigated.

In the key switch device 1, since the projections 821 are provided on the lower surface of the front side end portion 82 of the outer frame 8 which approaches the membrane sheet 3 in a case where the key top 4 is pressed down, and also the receiving portions 23 which receive the projections 821 are provided in areas facing the projections 821 in the base plate 2 in a case where the key top 4 is pressed down, even in a case where a portion distant from the center of the key top 4 is pressed down, the projections 821 do not bounce off the base plate 2 under the membrane sheet 3 and the membrane sheet 3 mitigates impact when the projections 821 impact against the membrane sheet 3. In this way, even if a small keystroke is made, a bottom-out feeling when operating a key (the key top 4) is able to be suppressed.

In addition, in the key switch device 1 a structure has been described in which the projections 821 are provided on the surface facing the membrane sheet 3 of the guide mechanism 6 and also the receiving portions 23 are provided in areas facing the projections 821 in the base plate 2 in a case where the key top 4 is pressed down. However, a configuration is also allowable in which projections are provided on the lower end face facing the membrane sheet 3 of the key top 4 and also receiving portions are provided in areas facing the projections in the base plate 2 in a case where the key top 4 is pressed down.

Further, a structure has been described in which the areas where the locking pieces 21L and 21R supporting the inner frame 7 are cut and raised are set to be the receiving portions. However, provided that the areas are areas facing the projections 821 in a case where the key top 4 is pressed down, the areas are not limited to areas that pass through the base plate 2, and the receiving portions may also be concave portions recessed from the upper surface.

In addition, a structure has been described in which the projections 821 are provided on the lower surface of the front side end portion 82 of the outer frame 8. However, the projections may also be provided on the lower surface of a side portion of the outer frame 8, provided that the surface is a surface facing the membrane sheet 3.

Figure 8:
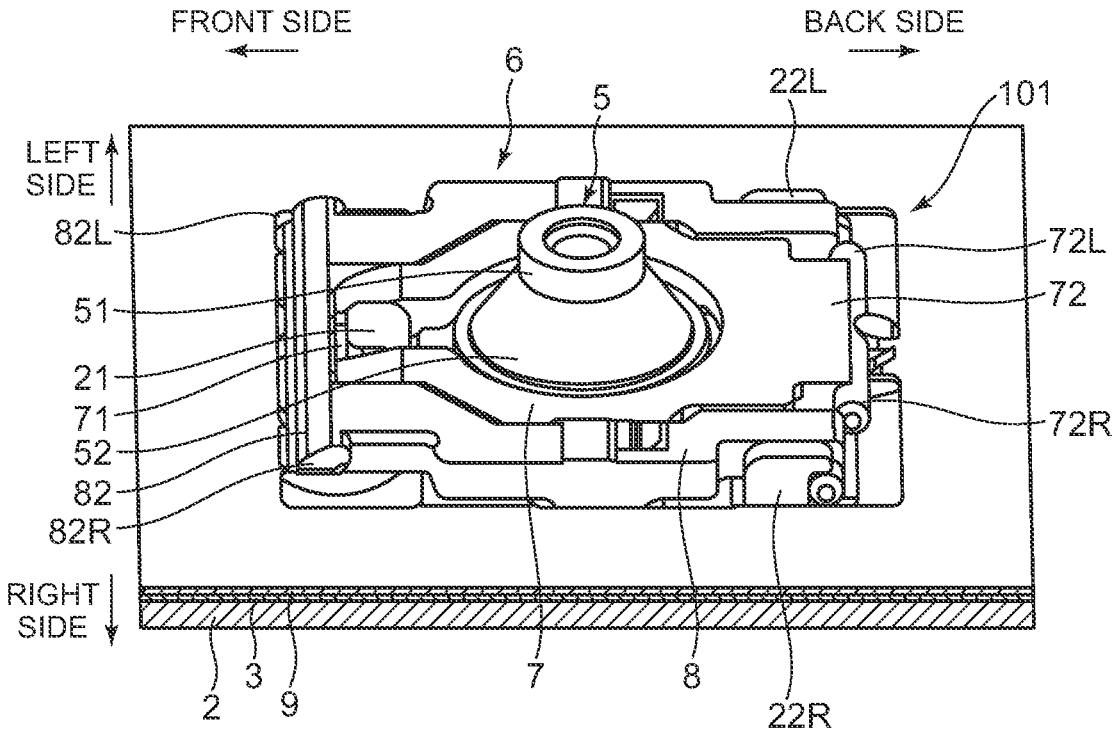
FIG. 8 is a perspective view of a key switch device that is Embodiment 2 of the invention, as viewed from the upper right side, and is a diagram illustrating a state where a key top is removed.
Figure 9:
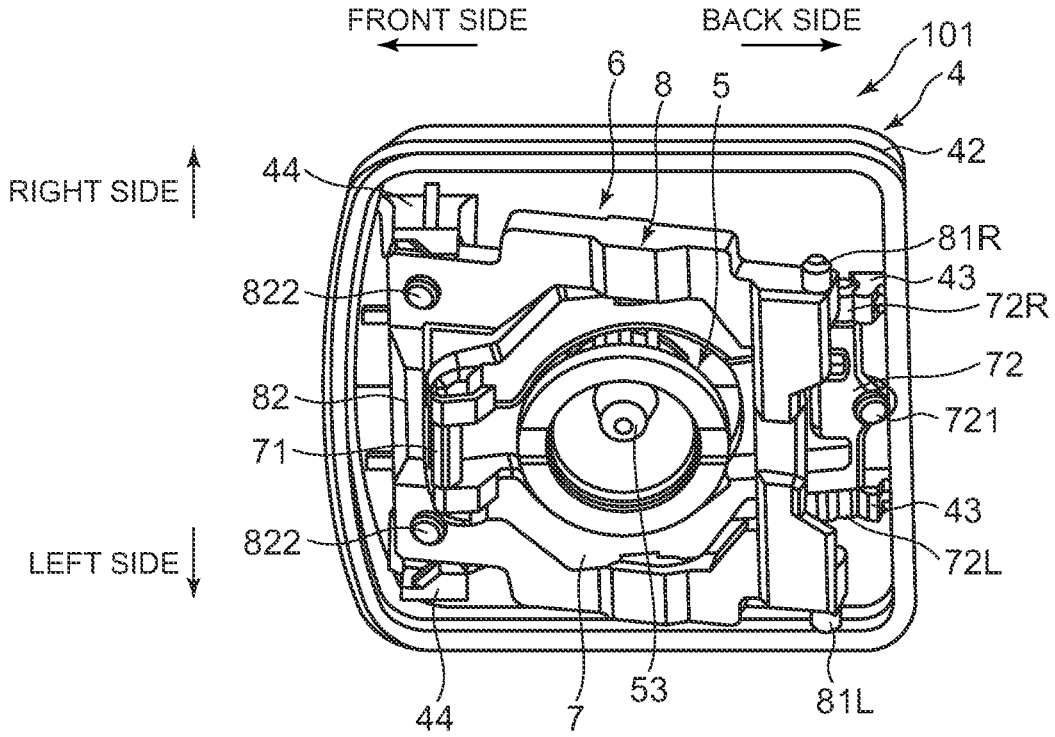
FIG. 9 is a perspective view of the key switch device illustrated in FIG. 8, as viewed from the lower right side, and is a diagram in which a base plate, a switch sheet, and a dome sheet are omitted.
Figure 10:
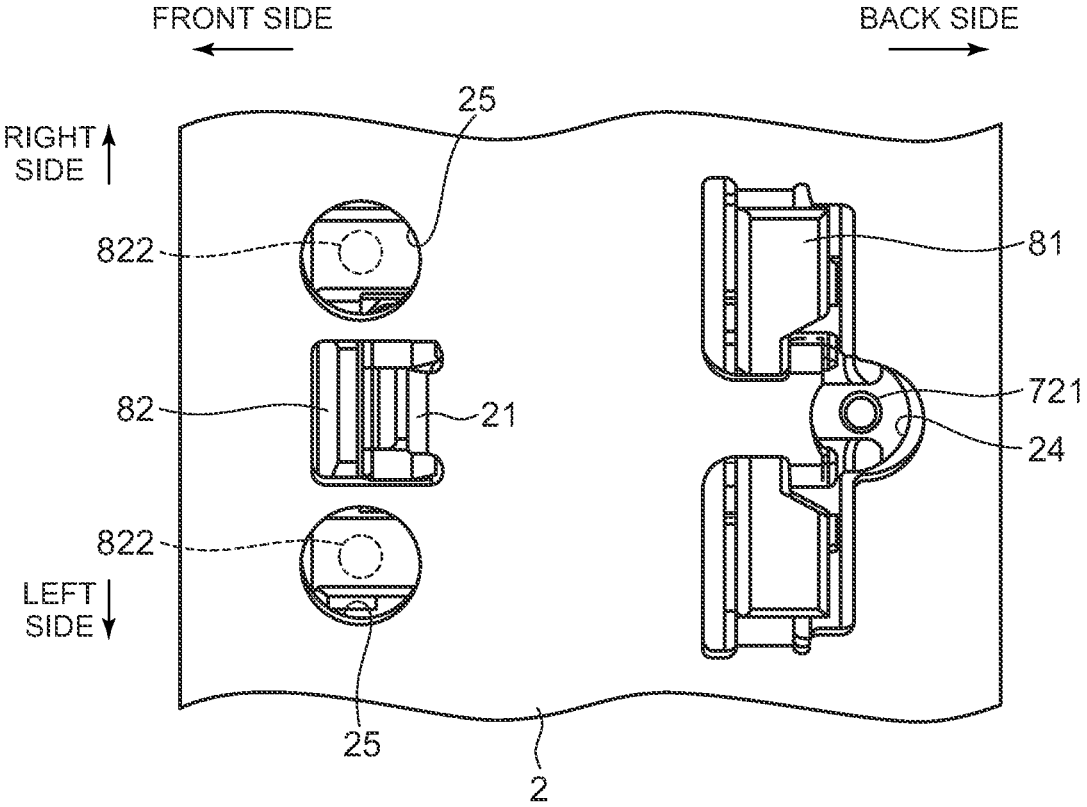
FIG. 10 is a bottom view of the key switch device illustrated in FIG. 8.

FIG. 8 is a perspective view of a key switch device of another embodiment, as viewed from the upper right side, and is a diagram illustrating a state where a key top is removed, and FIG. 9 is a perspective view of the key switch device illustrated in FIG. 8, as viewed from the lower right side, and is a diagram in which a base plate, a switch sheet, and a dome sheet are omitted. Further, FIG. 10 is a bottom view of the key switch device illustrated in FIG. 8.

A key switch device 11 in this embodiment is different from the key switch device 1 described above in that a dome sheet 9 is laminated over the membrane sheet 3, projections 721 and 822 are respectively provided on the lower surface of the inner frame 7 and the lower surface of the outer frame 8, and also receiving portions 24 and 25 are provided in areas facing the projections 721 and 822 in the base plate 2 in a case where the key top 4 is pressed down. In the description of the key switch device 11, a configuration in common with the key switch device 1 described above is denoted by the same reference numeral and description is omitted.

The dome sheet 9 of the key switch device 11 that is this embodiment is laminated over the membrane sheet 3 and the rubber dome 5 described above is bonded to the upper surface of the dome sheet 9. The dome sheet 9 is formed of PET film thinner than the membrane sheet 3 and delivered in a state where the rubber dome 5 is bonded thereto.

As illustrated in FIG. 9, in the key switch device 11, a single projection 721 is provided on the lower surface of the back side end portion 72 of the inner frame 7 constituting the guide mechanism 6, so as to divide the back side end portion 72 into two portions. The projection 721 is formed in a semi-spherical shape, whereby even if the projection 721 impacts against the dome sheet 9, the projection 721 does not damage the dome sheet 9. In addition, the inner frame 7 of the key switch device 11 is locked at the middle of the front side end portion 71 to a shaft through a locking piece 21 cut and raised in the base plate 2 for convenience of a space.

In the key switch device 11, two projections 822 are respectively provided on both sides of the lower surface of the front side end portion 82 of the outer frame 8 constituting the guide mechanism 6. Each of the two projections 822 is formed in a semi-spherical shape, whereby even if the projection 822 impacts against the dome sheet 9, the projection 822 does not damage the dome sheet 9.

As illustrated in FIG. 10, in the key switch device 11, the receiving portions 24 and 25 are provided in areas which respectively face the three projections 721 and 822 in the base plate 2 in a case where the key top 4 (refer to FIG. 9) is pressed down.

The receiving portions 24 and 25 of the key switch device 11 are provided so as to make the lower sides of areas against which the projections 721 and 822 impact, of the dome sheet 9, into cavities, and in this way, even if the projections 721 and 822 impact against the dome sheet 9, the projections 721 and 822 do not bounce off the base plate 2 under the dome sheet 9, so that the receiving portions 24 and 25 function as cushions to mitigate impact.

In the key switch device 11 areas provided separately from portions where the locking pieces 21, 22L and 22R are cut and raised are set to be the receiving portions 24 and 25.

In the key switch device 11, since the projections 721 and 822 are provided on the lower surface of the back side end portion 72 of the inner frame 7 and the lower surface of the front side end portion 82 of the outer frame 8, which approach the dome sheet 9 in a case where the key top 4 is pressed down, and also the receiving portions 24 and 25 which receive the projections 721 and 822 are provided in areas facing the projections 721 and 822 in the base plate 2 in a case where the key top 4 is pressed down, even in a case where a portion distant from the center of the key top 4 is pressed down, the projections 721 and 822 do not bounce off the base plate 2 under the dome sheet 9 and impact when the projections 721 and 822 impact against the dome sheet 9 is mitigated. In this way, even if a small keystroke is made, a bottom-out feeling when operating a key (the key top 4) is able to be suppressed.

Further, since the dome sheet 9 with the rubber dome 5 bonded thereto is laminated over the membrane sheet 3, the need to bond the rubber dome 5 to the membrane sheet 3 is eliminated.

In addition, since the projections 721 and 822 are respectively provided on the lower surface of the back side end portion 72 of the inner frame 7 and the lower surface of the front side end portion 82 of the outer frame 8 and also the receiving portions 24 and 25 are provided in areas facing the projections 721 and 822 in the base plate 2 in a case where the key top 4 is pressed down, impact is able to be mitigated equally in any case of a case where a portion separated from the center of the key top 4 to the front side is pressed down and a case where a portion separated from the center of the key top 4 to the back side is pressed down.

In addition, in the key switch device 11, a structure has been described in which the projections 721 and 822 are respectively provided on the lower surface of the back side end portion 72 of the inner frame 7 and the lower surface of the front side end portion 82 of the outer frame 8. However, the projections may also be provided on the lower surface of a side portion of the inner frame 7 and the lower surface of a side portion of the outer frame 8, provided that the surfaces are surfaces facing the dome sheet 9.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A key switch device comprising:

a base plate;

a membrane sheet laminated on the base plate, wherein the sheet comprises a first lower sheet layer, a second middle sheet layer, and a third upper sheet layer;

a key top disposed above the membrane sheet;

an elastic dome that is disposed between the membrane sheet and the key top and presses the membrane sheet in response to the key top being pressed down;

a guide mechanism that is foldably mounted between the base plate and the key top and supports the key top so as to be movable up and down;

the guide mechanism comprising an inner frame and outer frame, wherein the inner frame and outer frame are mounted in a diagonally crossing manner;

projections provided on a bottom surface of the outer frame of the guide mechanism that face the membrane sheet and that approach and impact the membrane sheet in a case where a portion distant from the center of the key top is pressed down, wherein the projections comprise at least two projections being located on a front side of the key switch device, wherein the projections are a semi-spherical shape; and receiving portions in the base plate which face the projections and receive the projections in a case where the portion distant from the center of the key top is pressed down and prevent the projections from touching the base plate, wherein the receiving portions are located on locking pieces that support the inner frame of the guide mechanism;

wherein the projections and receiving portions prevent other portions of the guide mechanism from impacting the membrane sheet in a case where the portion distant from the center of the key top is pressed down.

2. The key switch device of claim 1, wherein the membrane sheet is a switch sheet in which contacts are closed responsive to pressing by the elastic dome.

3. The key switch device of claim 1, wherein the elastic dome is a rubber dome.

4. The key switch device of claim 1, wherein the membrane sheet is a dome sheet to which the elastic dome is fixed.

5. The key switch device of claim 1, wherein the receiving portions pass through the base plate.

6. The key switch device of claim 1, wherein:

the inner frame has an inner shape forming a circular shape encompassing the elastic dome; and the outer frame has an inner shape forming a rectangular shape encompassing the inner frame.

7. The key switch of claim 1, the outer frame includes shafts formed on left and right sides of the outer frame that are rotatably locked to locking pieces formed on an upper surface of the base plate.

8. An apparatus, comprising:

a housing having a keyboard disposed therein;

said keyboard comprising a plurality of key switch devices;

at least one of the plurality of key switch devices comprising:

a base plate;

a membrane sheet laminated on the base plate, wherein the membrane sheet comprises a first lower sheet layer, a second middle sheet layer, and a third upper sheet layer;

a key top disposed above the membrane sheet;

an elastic dome that is disposed between the membrane sheet and the key top and presses the sheet in response to the key top being pressed down;

a guide mechanism that is foldably mounted between the base plate and the key top and supports the key top so as to be movable up and down;

the guide mechanism comprising an inner frame and outer frame, wherein the inner frame and outer frame are mounted in a diagonally crossing manner;

projections provided on a bottom surface of the outer frame of the guide mechanism that face the membrane sheet and that approach and impact the membrane sheet in a case where a portion distant from the center of the key top is pressed down, wherein the projections comprise at least two projections being located on a front side of the at least one of a plurality of key switch devices, wherein the projections are a semi-spherical shape; and receiving portions in the base plate which face the projections and receive the projections in a case where the portion distant from the center of the key top is pressed down and prevent the projections from touching the base plate, wherein the receiving portions are located on locking pieces that support the inner frame of the guide mechanism;

wherein the projections and receiving portions prevent other portions of the guide mechanism from impacting the membrane sheet in a case where the portion distant from the center of the key top is pressed down.

9. The apparatus of claim 8, wherein the membrane sheet is a switch sheet in which contacts are closed responsive to pressing by the elastic dome.

10. The apparatus of claim 8, wherein the elastic dome is a rubber dome.

11. The apparatus of claim 8, wherein the membrane sheet is a dome sheet to which the elastic dome is fixed.

12. The apparatus of claim 8, wherein the receiving portions pass through the base plate.

13. The apparatus of claim 8, further comprising a display housing.

14. The apparatus of claim 8, wherein:

the inner frame has an inner shape forming a circular shape encompassing the elastic dome; and the outer frame has an inner shape forming a rectangular shape encompassing the inner frame.

* * * * *